United States Patent [19]

Patel et al.

[11] 4,191,148

[45] Mar. 4, 1980

[54] AFTERCOOLER ASSEMBLY FOR INTERNAL COMBUSTION ENGINE

[75] Inventors: Harshad H. Patel; Tejandra N. Bose, both of Columbus, Ind.

[73] Assignee: Cummins Engine Company, Inc., Columbus, Ind.

[21] Appl. No.: 811,912

[22] Filed: Jun. 30, 1977

[51] Int. Cl.[2] ..... F28F 1/32; F02B 33/44

[52] U.S. Cl. ..... 123/119 CD; 165/162; 165/172

[58] Field of Search ..... 165/162, 172; 123/119 CD; 60/599, 611

[56] References Cited

U.S. PATENT DOCUMENTS

| | | | |
|---|---|---|---|
| 1,592,538 | 7/1926 | Price | 165/162 |
| 1,725,549 | 8/1929 | Swenson | 165/162 |
| 1,856,618 | 5/1932 | Brown | 165/162 |
| 2,166,808 | 7/1939 | Flindt | 165/69 |
| 2,346,463 | 4/1944 | Szekely | 123/119 CD |
| 2,440,803 | 5/1948 | Lea | 165/172 |
| 3,027,706 | 4/1962 | Sprick | 123/119 CD |
| 4,000,725 | 1/1977 | Harris | 123/119 CD |

FOREIGN PATENT DOCUMENTS

| | | | |
|---|---|---|---|
| 543359 | 2/1942 | United Kingdom | 123/119 CD |

*Primary Examiner*—Ronald H. Lazarus

*Attorney, Agent, or Firm*—Gary M. Gron; Robert T. Ruff

[57] ABSTRACT

The disclosure illustrates a water to air aftercooler assembly in which an elongated coolant tube bundle is supported by plates spaced between heat exchange fins to form an aftercooler core. The support plates are secured to opposed walls forming a part of the aftercooler housing. This arrangement permits a simplified and economical aftercooler core. In addition it provides an improved support for the aftercooler core and structurally reinforces the aftercooler housing.

9 Claims, 6 Drawing Figures

AFTERCOOLER ASSEMBLY FOR INTERNAL COMBUSTION ENGINE

The present invention relates to aftercooler (also known as intercooler) assemblies for internal combustion engines and more specifically to structural features of such aftercoolers.

It has been known for a long time that the specific output of a supercharged or turbocharged engine may be increased by cooling the air after it has been compressed and before it enters the engine cylinders for combustion. The reasoning behind this approach is that the cooler air enables a denser charge in the cylinders to generate a greater amount of energy upon combustion.

One well known assembly to achieve this end is a water to air aftercooler. Such a unit will include a housing having an inlet for pressurized air and one or more outlets leading to the engine cylinders. An aftercooler heat exchange core is positioned in the housing and comprises tubes through which engine coolant passes. The tubes extend through fins to increase the heat transfer effect.

The engine coolant temperature is in the nieghborhood of 180° F. The temperature of the air entering the aftercooler housing is 350° F., but as it passes over the aftercooler core its temperature is lowered to 230° F.

Although this type of aftercooler performs an effective job of lowering the engine inlet air temperature, it introduces several potential structural problems. The aftercooler core must be mounted in such a way that it remains watertight in spite of severe engine and vehicle vibrations. A number of aftercooler designs have been proposed to support the aftercooler core. One example is shown in the U.S. Pat. to Maxwell No. 3,091,228. This patent illustrates an aftercooler where the core is supported through baffle plates having outwardly facing flanges. The flanges are clamped between housing halves to support the core.

The core for the above type of aftercooler is elaborate and expensive to manufacture because of the need to weld the baffle plates to the tube bundle and weld the flange to the baffle plates. Furthermore, when highly pressurized air is delivered to the aftercooler, the side walls of the housing can bulge and may even break the weld joints. This would leave the aftercooler core not supported between its ends. Without support, engine and road vibrations can in time cause the tube bundle to leak.

The above problems are solved by an aftercooler which comprises an aftercooler housing and an aftercooler core positioned in it. The core includes a plurality of coolant conduits and at least one core support plate extending across the conduits. The support plate is positively secured to the housing walls so that the aftercooler core is supported and the housing is structurally reinforced.

The above and other related features of the present invention will be apparent from a reading of the following description of the disclosure shown in the accompanying drawings and the novelty thereof pointed out in the appended claims.

Figure 1:
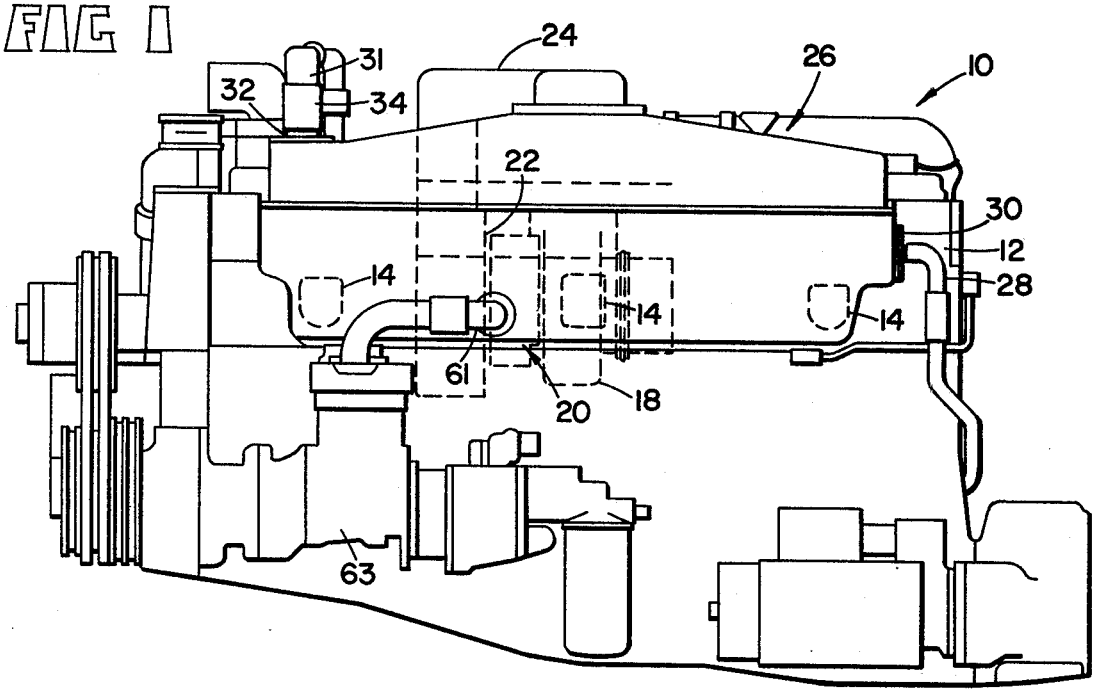
FIG. 1 is a simplified side view of an internal combustion engine along with an aftercooler assembly embodying the present invention.
Figure 4:
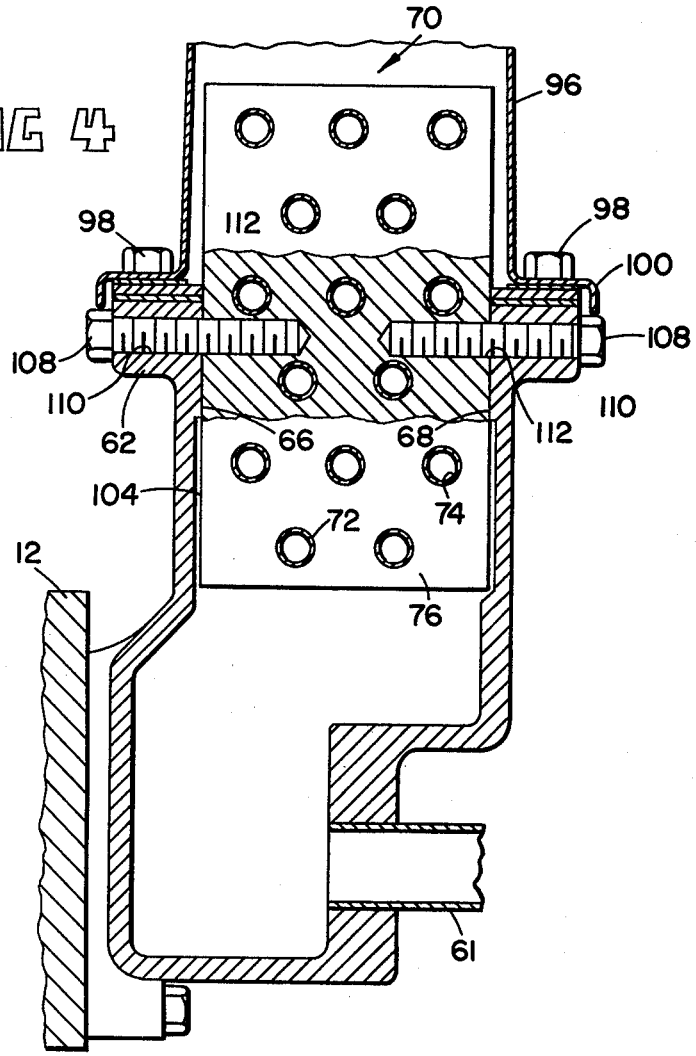
FIGS. 4, 5, 6 are various enlarged cross section views taken on lines 4—4, 5—5 and 6—6 respectively of FIG. 2.
Figure 2:
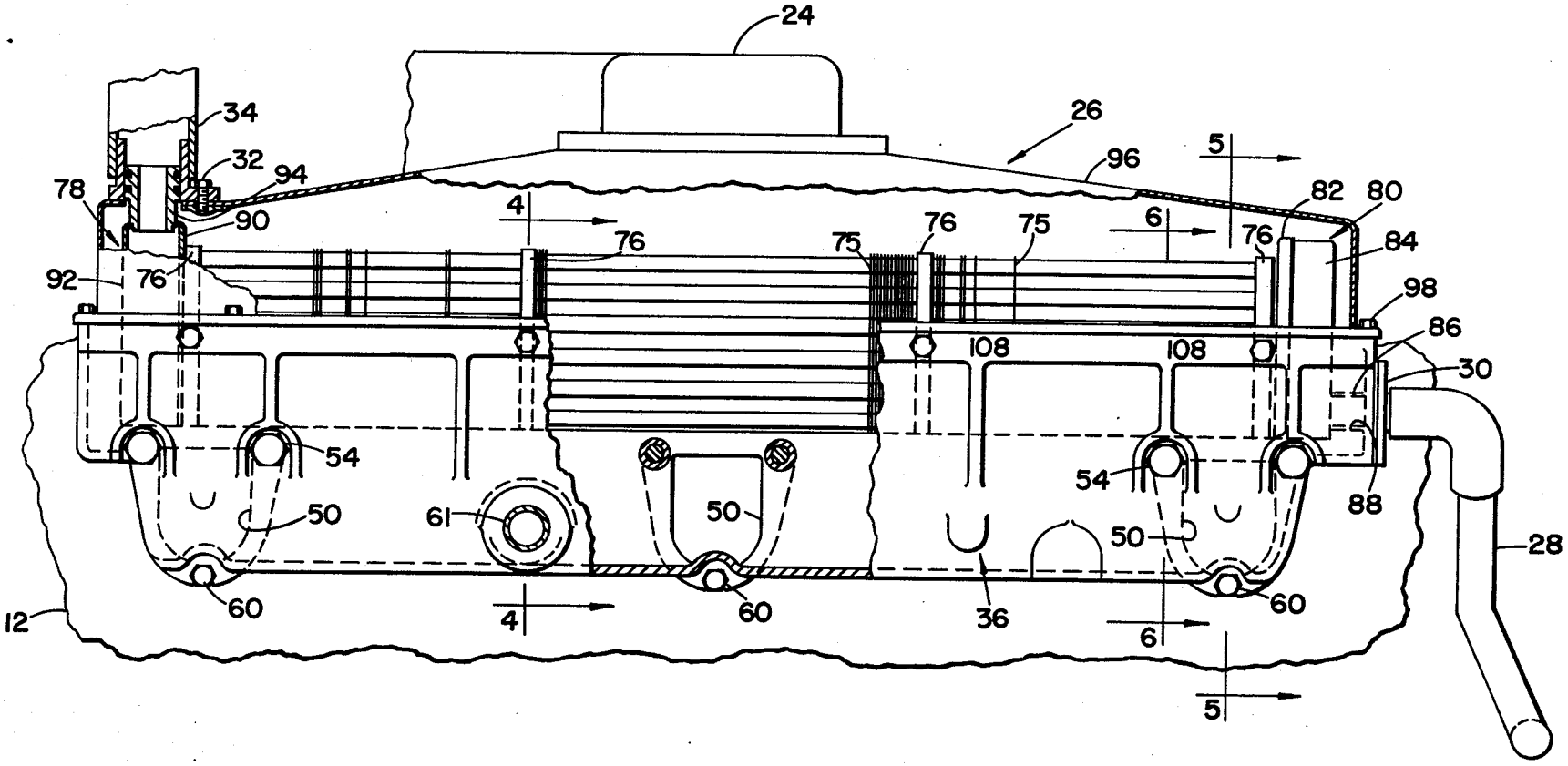
FIG. 2 is an enlarged side view of the aftercooler assembly of FIG. 1.
Figure 3:
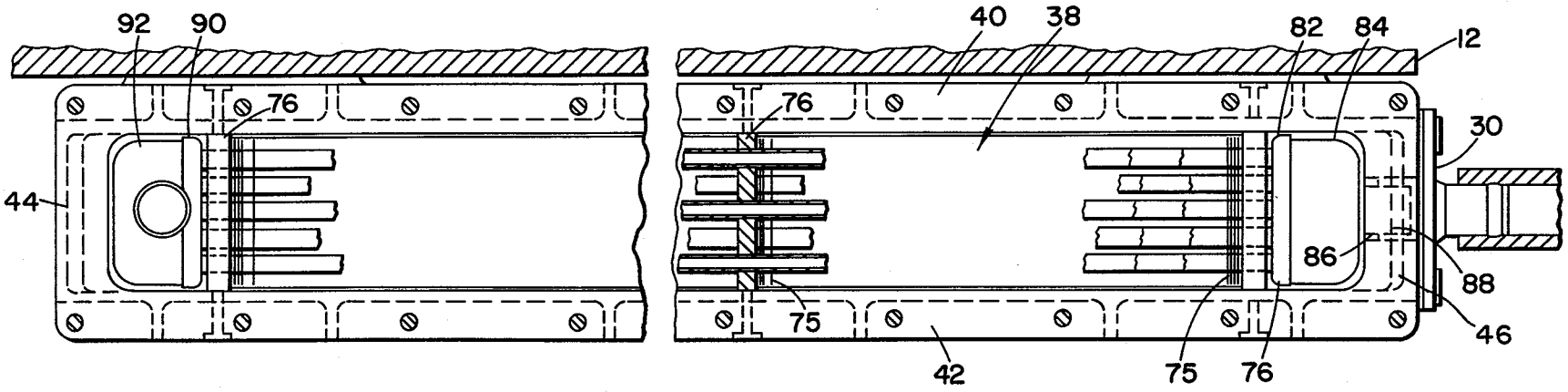
FIG. 3 is an enlarged plan view taken of the aftercooler assembly, showing an upper aftercooler cover removed, of FIG. 2.
Figure 5:
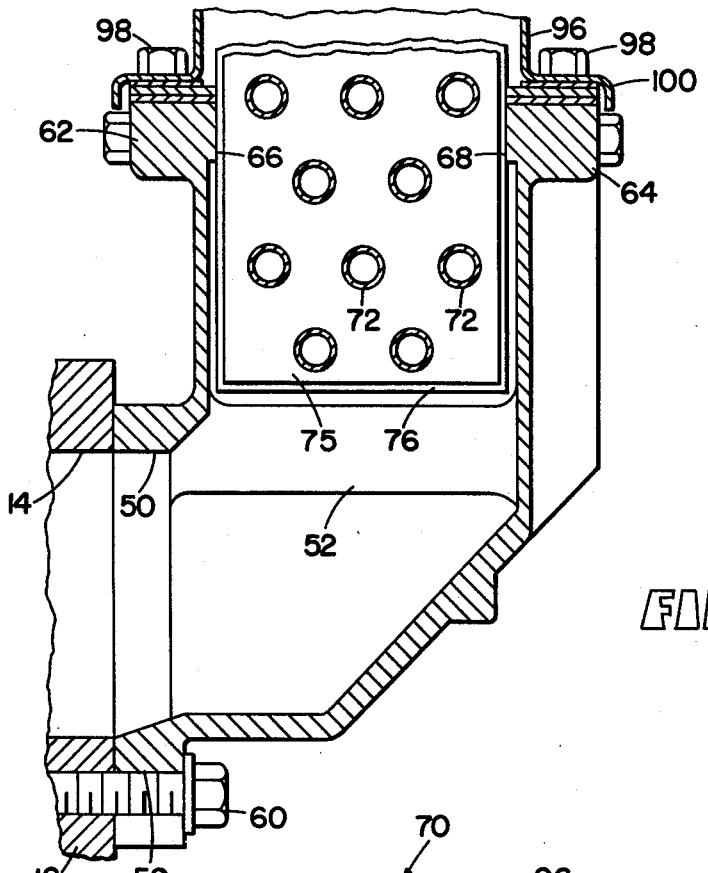
Figure 6:
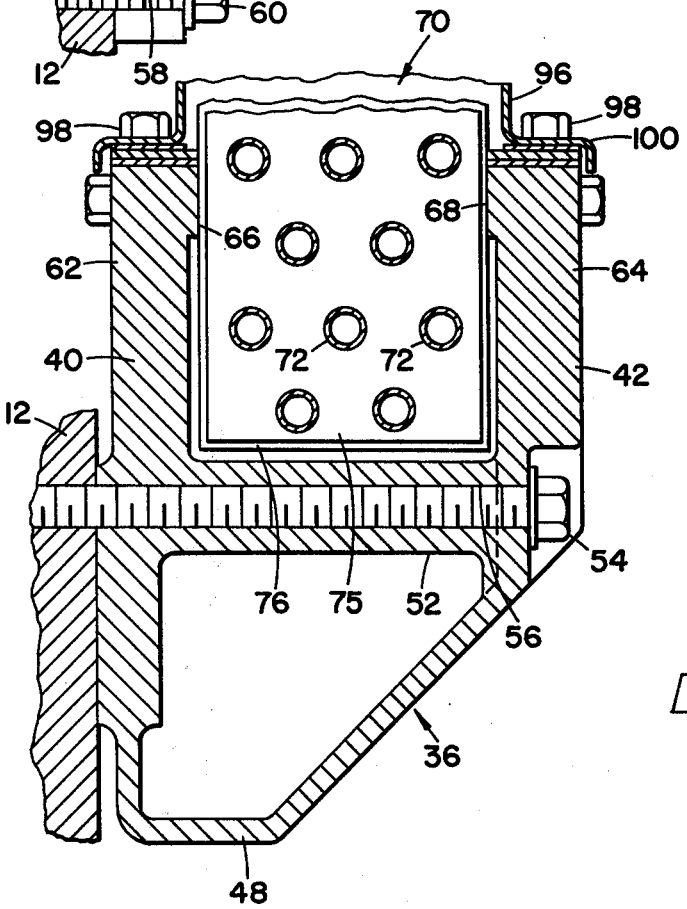

Referring to FIG. 1 there is shown a portion of an internal combustion engine 10 with which the aftercooler of the present invention may be used. The engine includes a plurality of reciprocating pistons connected to a crankshaft (both not shown) to provide a rotary output. Suitable valve mechanism (not shown) in a head 12 for the engine 10 admits air from intake ports 14 to the cylinder for mixing with fuel and combustion. As illustrated, engine 10 is of the compression ignition type where fuel is injected into the cylinders for combustion after the air within the cylinder is compressed enough to increase its temperature above the self ignition temperature of the fuel air mixture. Further details of such an engine are so well known to those skilled in the art that they will not be elaborated to simplify the discussion of the present invention.

Additional valve mechanism permits exhaust gases to pass from the cylinder to exhaust manifolds (not shown). From manifolds the gases pass across the turbine 18 of a turbocharger 20.

Turbocharger 20 includes a compressor 22 driven by the turbine 18 to pressurize air for delivery through a cross over duct 24 connecting to an aftercooler assembly 26 which embodies the present invention. The aftercooler assembly 26 is a water to air type similar to that described in the introduction. It receives liquid coolant from the engine cooling system via conduit 28 which terminates in a flange 30 secured to the aft end of aftercooler assembly 26. The return of the coolant to the engine cooling system is by means of a tube 31 connected to an outlet fitting 32 on aftercooler 26 by a flexible hose 34.

Referring now to FIGS. 2 through 6 the aftercooler assembly 26 comprises an elongated lower housing 36 having an upperward facing trough 38 formed by opposed elongated walls 40 and 42 respectively joined by fore and aft walls 44 and 46. The lower portion of wall 42 angles toward the lower edge of wall 40 and connects with it through a base portion 48. Wall 40 has a plurality of openings 50 that are in alignment with the engine intake ports 14 (see FIG. 5). Integral bridge portions 52 extend between walls 40 and 42 at locations adjacent outlets 50. Bolts 54 extend through holes 56 in the bridge portions 52 to releasably secure the housing 36 to the head 12. Additional notches 58 in the lower section of wall 40 enable screws 60 to hold the lower section of the housing 36 to the head 12 (see FIG. 5). A conduit 61 is received in wall 42 to provide an inlet for an air compressor 63 from the normally filtered air existing in housing 36.

The upper edges of walls 40 and 42 each contain flange sections 62 and 64 which include opposed elongated wall sections 66 and 68 respectively. An aftercooler core generally indicated at 70 is received between these wall sections. The aftercooler core 70 is positioned adjacent the upper flange sections 62 and 64 so that a portion of the core 70 is above the sections and a portion is below. It is also positioned so that air from crossover duct 24 must pass over it before exiting from outlets 50. The aftercooler core 70 comprises a plurality of elongated conduits 72 extending lengthwise in the open trough 38. These conduits 72 extend through holes 74 in a plurality of support plates 76 extending across or generally transverse to the longitudinal axis of the conduits 72. The conduits 72 are fixed to the support plates 76 by a suitable means such as brazing. A plurality of relatively thin fins 75 extend across conduits 72 to increase the heat exchange effect.

Adjacent the support plates 76 at the ends of the conduits are forward and aft headers 78, 80 respectively. These headers include an open face which is connected to the ends of the conduits 72.

The aft header 80 includes a base plate 82 secured to the aft most support plate 76 and a cover 84 secured to the base 82 to form a chamber. An outlet fitting 86 is secured to cover 84 and is received in a bore 88 of the flange 30 for a water tight connection to the engine cooling system. The forward header 78 includes a plate 90 secured to the forward most support plate 76 and a cover 92 secured to base 90 to form a chamber receiving coolant from the ends of conduit 72. A fitting 94 is secured to cover 92 and extends vertically for connection with the liquid cooling system, as described below.

A stamped steel cover 96 is received over the trough-like opening of the lower housing 36 and has an integral circumferential flange 100. Screws 98 extend through suitable holes in flange 100 and thread into flange sections 62 and 64 on housing 36 to hold it in place. The cross over duct 24 is suitably secured to cover 96. The outlet fitting 32 is secured to cover 92 over fitting 94 and connects with tube 30 through the flexible hose 34.

The support plates 76 have sufficient width W so that their edges 104 and 106 abut faces 66 and 68 respectively. A pair of screws 108 extend through openings 110 in flange sections 62 and 64 and are threaded into bores 112 in the edges 104 and 106 of support plates 76.

This feature constitutes an important aspect of applicants' invention because it enables constructional and structural advantages not found in the prior art. The aftercooler core 70 can be manufactured with a minimum of cost. The technique of forming a coolant conduit with heat exchange fins and support plates is easily automated. So to is the fabrication of the headers. What has previously necessitated a complicated and time consuming manufacturing technique is the provision of a baffle around this assembly together with the circumferential mounting flange. The above construction eliminates these components and thus the manufacturing expense.

The above construction has still another advantage in that the support plates 76 serve the dual function of supporting the aftercooler core and reenforcing the side walls 40 and 42 of the lower housing. Thus when the engine is highly turbocharged the tendency of the walls to bow out is minimized, if not eliminated. The net effect of the above arrangement is an aftercooler assembly having greatly reduced manufacturing cost and a high degree of dependability.

While a preferred embodiment of the present invention has been described, it should be apparent to those skilled in the art that it may be practiced in other forms without departing from its spirit and scope.

Having thus described the invention what is claimed as novel and desired to be secured by Letters Patent of the United States is:

1. An aftercooler assembly for an internal combustion engine, said assembly comprising, housing means defining an elongated chamber having at least one inlet and outlet for air, said housing means having a pair of elongated opposed interconnected side and end walls forming an elongated trough having a substantially continuous planar surface; defined by the extremities of said side and end walls;

an elongated aftercooler core positioned in said chamber, said core comprising a plurality of coolant conduits extending generally parallel to the longitudinal axis of said housing means and having a pair of core support plates at opposite ends of said aftercooler core and at least one core support plate intermediate said end core support plates, all of said support plates extending generally transverse to and structurally connected to said coolant conduits; and means for securing said intermediate core support plate to both of said side walls adjacent said planar surface, thereby forming a structural support for said aftercooler core and reinforcing the side walls of said housing.

2. Apparatus as in claim 1 wherein:

said intermediate support plate is of sufficient width so that at least a portion of it extends between and abuts said opposed walls, said intermediate securing means comprises means extending through the side walls and securing said intermediate plate to said side walls at the portion where said plate abuts said side walls.

3. Apparatus as in claim 1 wherein:

said intermediate support plate is secured to said side walls adjacent said planar surface so that the aftercooler core extends above and below said planar surface;

said housing includes an elongated cover secured to said trough around said planar surface.

4. Apparatus as in claim 3 wherein said aftercooler core further comprises a plurality of relatively thin fins extending generally transverse to the longitudinal axis of said coolant conduits.

5. Apparatus as in claim 4 wherein said aftercooler core includes headers secured to said end support plates and being open to said elongated coolant conduits, one of said headers having a coolant connector extending in a direction parallel to the longitudinal axis of said aftercooler and the other header having a coolant connector extending at right angles to the first named coolant connector.

6. Apparatus as in claim 5 wherein:

all of said support plates are of sufficient width to extend between and abut said opposed side walls, said securing means comprises means extending through the side walls and securing all of said support plates to said side walls at the portion where said plates abut said side walls.

7. Apparatus as in claim 3 wherein:

said trough has a plurality of spaced openings in one of said side walls forming outlets for said housing means; said openings being positioned so that air must pass across said aftercooler core before exiting through said openings, said cover has an opening forming an air inlet for said housing means.

8. Apparatus as in claim 7 wherein said trough is cast and said cover is stamped.

9. Apparatus as in claim 6 wherein said support plates have threaded sockets in the portions abutting said side walls and said securing means comprises screws extending through said side walls and threaded into said sockets.

* * * * *